US008695573B2

(12) United States Patent
Bierl et al.

(10) Patent No.: US 8,695,573 B2
(45) Date of Patent: Apr. 15, 2014

(54) HYDROCARBON SENSOR TO REGULATE FLOW RATE IN A FUEL LINE

(75) Inventors: Rudolf Bierl, Regensburg (DE); Stephan Heinrich, Pfeffenhausen (DE); Wolfgang Mai, Kronberg (DE); Paul Rodatz, Landshut (DE); Manfred Weigl, Viehhausen (DE); Andreas Wildgen, Nittendorf (DE)

(73) Assignee: Continental Automotive GmbH, Hannover (DE)

( * ) Notice: Subject to any disclaimer, the term of this patent is extended or adjusted under 35 U.S.C. 154(b) by 461 days.

(21) Appl. No.: 13/000,544

(22) PCT Filed: Jun. 29, 2009

(86) PCT No.: PCT/EP2009/058084

§ 371 (c)(1),
(2), (4) Date: Feb. 14, 2011

(87) PCT Pub. No.: WO2010/000682

PCT Pub. Date: Jan. 7, 2010

(65) Prior Publication Data

US 2011/0174276 A1 Jul. 21, 2011

(30) Foreign Application Priority Data

Jul. 4, 2008 (DE) ..... 10 2008 031 649

(51) Int. Cl.
*F02M 33/02* (2006.01)

(52) U.S. Cl.
USPC ..... 123/520; 123/518; 123/704; 123/516

(58) Field of Classification Search
USPC ..... 123/516, 518, 519, 520, 697, 698, 704, 123/198 D, 381, 494, 198 DB; 701/103, 112, 701/114; 702/50, 53, 182, 183, 185; 73/114.42
See application file for complete search history.

(56) References Cited

U.S. PATENT DOCUMENTS

| | | | | |
|---|---|---|---|---|
| 5,823,171 | A * | 10/1998 | Farmer et al. | 123/704 |
| 6,227,177 | B1 * | 5/2001 | Yamafuji et al. | 123/520 |
| 6,916,664 | B2 | 7/2005 | Bonne et al. | |
| 7,188,519 | B2 * | 3/2007 | Hornung et al. | 73/204.26 |
| 7,755,466 | B2 * | 7/2010 | Beck et al. | 338/25 |
| 8,312,868 | B2 * | 11/2012 | Bierl et al. | 123/518 |
| 2004/0226543 | A1 | 11/2004 | Penschuck | |
| 2010/0186482 | A1 * | 7/2010 | Bierl et al. | 73/24.06 |
| 2011/0126611 | A1 * | 6/2011 | Bierl et al. | 73/25.05 |
| 2011/0137540 | A1 * | 6/2011 | Mai et al. | 701/103 |
| 2011/0168139 | A1 * | 7/2011 | Knittel et al. | 123/518 |

FOREIGN PATENT DOCUMENTS

| | | | |
|---|---|---|---|
| DE | 39 19 033 | A1 | 12/1990 |
| WO | WO 03/106985 | A1 | 12/2003 |

* cited by examiner

*Primary Examiner* — Stephen K Cronin
*Assistant Examiner* — Gonzalo Laguarda
(74) *Attorney, Agent, or Firm* — Cozen O'Connor

(57) ABSTRACT

During operation of an internal combustion engine system which has at least one sensor for measuring a hydrocarbon content of a gas stream in a line, a temperature is determined at the at least one sensor. If the temperature is greater than a prespecified temperature, the flow of gas through the line is interrupted.

6 Claims, 2 Drawing Sheets

HYDROCARBON SENSOR TO REGULATE FLOW RATE IN A FUEL LINE

PRIORITY CLAIM

This is a U.S. national stage of Application No. PCT/EP2009/058084, filed on Jun. 29, 2009, which claims priority to German Application No: 10 2008 031 649.0, filed: Jul. 4, 2008, the contents of which are incorporated herein by reference.

BACKGROUND OF THE INVENTION

1. Field of the Invention

The invention relates to an internal combustion engine and method for operating an internal combustion engine.

2. Related Art

From the fuel tank of a motor vehicle in which gasoline is stored, there can emerge exhaust gases that are released from the fuel. At high outside temperatures or as a result of shaking of the fuel tank during a journey, volatile hydrocarbons can be released from the fuel and leave the fuel tank in gaseous form. To counteract this, fuel tanks may be closed off in a gas-tight fashion. The volatile hydrocarbons are then temporarily stored in an accumulator and can be supplied to the intake air of the combustion engine. A problem is however that the gaseous hydrocarbons can ignite in an uncontrolled manner in the supply lines.

SUMMARY OF THE INVENTION

It is an object of the invention to specify an internal combustion engine and a method for operating an internal combustion engine which can be operated more safely.

A method for operating an internal combustion engine which has at least one sensor for measuring a hydrocarbon content of a gas flow in a line comprises determining a temperature at the at least one sensor. If the temperature is higher than a predefined temperature, the gas flow through the line is interrupted.

A fire of hydrocarbon-containing gas can therefore be detected, and countermeasures can be taken.

The method comprises evaluating a signal of at least one temperature sensor. The method may comprise evaluating a signal of at least one semiconductor component. The semiconductor component is integrated in the at least one sensor. In this way, the temperature at the at least one sensor can be determined in a relatively simple manner.

The method comprises deactivating at least one heating element of the at least one sensor has for heating up the gas flow. A supply of current to the at least one heating element may be interrupted. The heating element may trigger a fire of the hydrocarbon gas as a result of a malfunction, and this cause of fire can be eliminated as a result of the deactivation or interruption of the supply of current.

The method comprises closing at least one valve which is arranged upstream of the at least one sensor. It is thus possible in the event of a fire to interrupt the supply of combustible gas and as far as possible prevent a further propagation of a fire.

A method for operating an internal combustion engine according to a further embodiment comprises determining a temperature at a temperature sensor. The internal combustion engine has at least one sensor for measuring a hydrocarbon content of a gas flow in a line, and the at least one sensor has the temperature sensor. A further temperature is determined at a further temperature sensor of the at least one sensor. The temperature difference between the temperature and the further temperature is determined and the gas flow is interrupted if the temperature difference is greater than a predefined temperature difference.

The method comprises closing at least one valve which is arranged upstream of the at least one sensor. In this way it is possible to prevent further combustible gas being supplied to the source of a fire, and a propagation of a fire can be effectively prevented.

The method comprises deactivating the at least one heating element which has the at least one sensor for heating up the gas flow. The supply of current to the at least one heating element may be interrupted. In this way, a cause of fire, for example a malfunction of the heating element, can be deactivated.

An internal combustion engine comprises at least one sensor for measuring a hydrocarbon content of a gas flow in a line. The internal combustion engine has a comparison device for comparing a temperature at the sensor with a predefined temperature. The internal combustion engine comprises at least one valve for interrupting the gas flow, which valve is arranged upstream of the at least one sensor. The at least one valve is regulated by the comparison device, such that the gas flow through the line is interrupted if the temperature is higher than the predefined temperature.

The at least one sensor may have at least one heating element for heating up a gas flow and have at least one temperature sensor. The temperature sensor can determine the temperature at the sensor.

The comparison device may be part of an engine controller to which the sensor is coupled. In this way, a fire can be detected in an effective manner and countermeasures may be regulated by the comparison device or by the engine controller.

BRIEF DESCRIPTION OF DRAWINGS

Further features, advantages and refinements will emerge from the following examples explained in conjunction with FIGS. 1 to 3, in which.

DETAILED DESCRIPTION OF THE DRAWINGS

Figure 1:
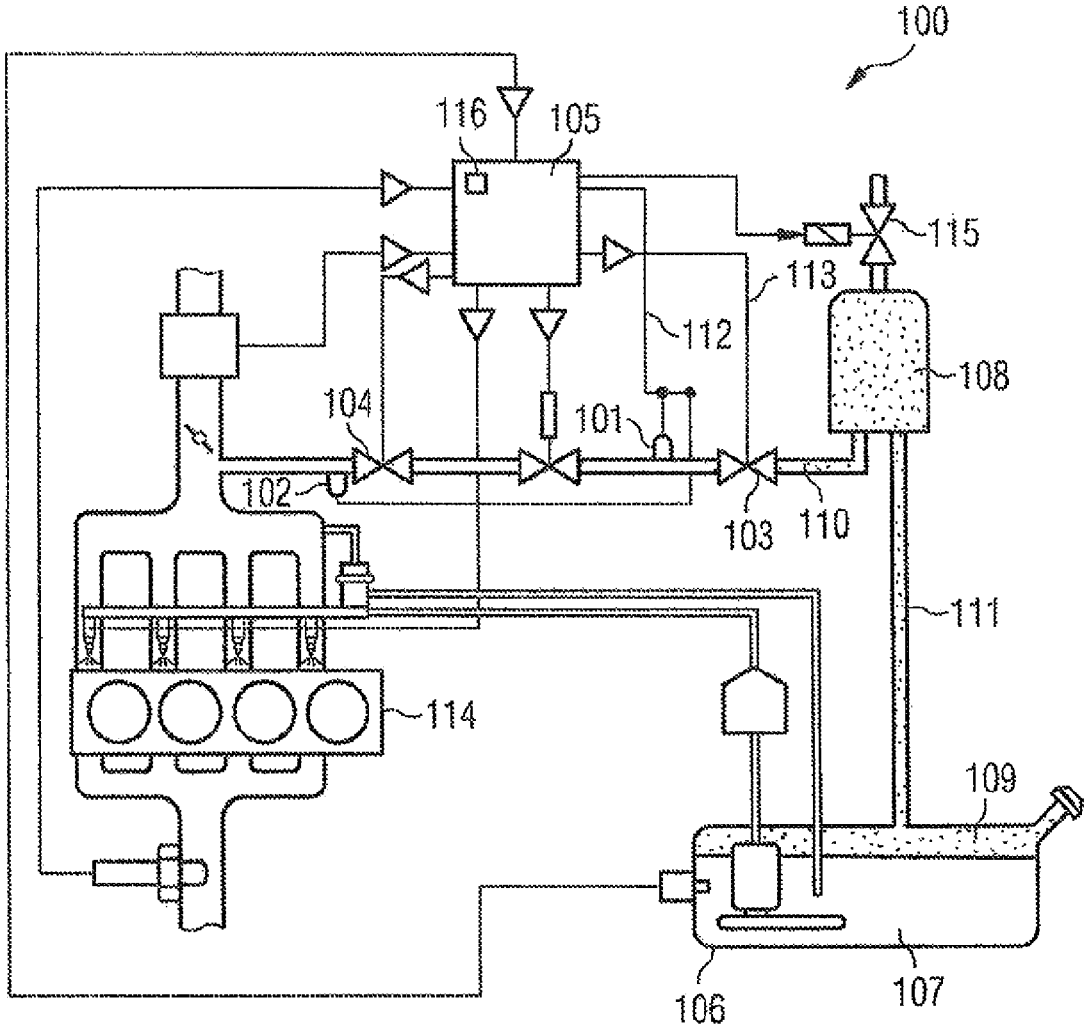
FIG. 1 is a schematic illustration of an internal combustion engine.

FIG. 1 shows an internal combustion engine system 100 having a fuel tank 106, a combustion engine 114 and also a hydrocarbon tank 108. Fuel 107 is stored in the fuel tank 106. Gaseous hydrocarbons 109 can be conducted out of the fuel tank into the hydrocarbon tank via a line 111, which is coupled to the fuel tank 106 and to the hydrocarbon tank 108. The hydrocarbon tank is coupled via a line 110 to the combustion engine 114, in particular to the intake tract of the combustion engine 114.

The line 110 has a valve 103 and a further valve 104 and also a hydrocarbon sensor 101 and a further hydrocarbon sensor 102. The hydrocarbon sensors 101, 102 are designed to measure a hydrocarbon content of a gas flow. It is also possible for only one hydrocarbon sensor to be provided, though more hydrocarbon sensors, for example two or more hydrocarbon sensors, may also be provided. The hydrocarbon sensors may also be arranged on further lines, for example the line 111. The valves are designed to interrupt the gas flow. It is also possible for only one valve to be provided, though more valves, for example two or more valves, may also be provided. The valves may also be arranged on further lines, for example the line 111.

The valve 103 is coupled to the engine controller 105 via an electrical line 113, and the sensors 101 and 102 are coupled to the engine controller 105 via an electrical line 112. The engine controller 105, which has a comparison device 116, regulates the valves 103, 104 and can evaluate signals from the sensors 101, 102.

Hydrocarbons, for example methane, butane, or propane, volatilize from the fuel 107, for example a gasoline. The different hydrocarbon chains have different evaporation temperatures, such that different hydrocarbons are released from the liquid fuel 107 depending on the outside temperature. The higher the outside temperature and therefore the temperature of the fuel 107, the more hydrocarbons pass into the gaseous phase. The tank 106 in which the fuel 107 is stored is of gas-tight design. The tank cover closes off a filler neck of the fuel tank in a gas-tight fashion. The hydrocarbon-containing gas mixture which forms in the tank 106 is conducted via the line 111 into the hydrocarbon tank 108.

The hydrocarbon tank may contain an activated carbon storage element. The evaporated hydrocarbons are absorbed, stored, and released again when required, by the activated carbon. When the hydrocarbon tank has absorbed a certain quantity of hydrocarbons, it can be emptied via the line 110. For this purpose, air is blown into the hydrocarbon tank from the outside via a valve 115, which air entrains the hydrocarbons. The hydrocarbon-containing air may be used as intake air for the combustion engine 114 and thereby contribute to the combustion in the engine. Since a certain amount of energy is supplied to the combustion engine by the hydrocarbons in the intake air, a correspondingly lower amount of fuel is injected by an injection system. To regulate said ratio, the hydrocarbon content of the supplied air is measured by the sensors 101 and 102.

Sensors 101, 102 for measuring a hydrocarbon content have a heating element for heating a gas flow and have a temperature sensor. Each sensor 101, 102 is for example integrated on a silicon chip. The gas flow flowing past the sensor element 101, 102 is heated, and the thermal conductivity or heat capacity of the gas flowing past can be determined on the basis of signals of the temperature sensor, which signals are evaluated by the engine controller 105. From this, it is possible to determine the concentration of the hydrocarbon in the gas, because this is proportional to the thermal conductivity or heat capacity of the gas.

In the event of a malfunction of the sensor for measuring the hydrocarbon content, for example overheating of the heating element or the formation of a spark on account of a dielectric breakdown, the hydrocarbon-containing gas in the line 110 can ignite. To be able to detect such a fire, the comparison device 116 which in the exemplary embodiment shown is part of the engine controller 105, compares a respective temperature at the hydrocarbon sensors 101, 102 with a predefined temperature which has been determined representatively for a fire. If the comparison device establishes that the temperature determined at the sensor element 101, 102 is higher than the predefined temperature, it can initiate measures. To prevent a supply of further combustible gas to the fire, the gas supply is interrupted. This may take place by closing the valve 103 or the valve 104. It is also possible for the valve 115 to be closed, and in this way for the emptying of the hydrocarbon tank to be stopped. If a fire is detected at the sensor 101, the valve 103 can be closed and the valve 104 can remain open. If a fire is detected at the valve 102, it is possible for either only the valve 104 to be closed or for the valves 103 and 104 to be closed.

A further measure which can be taken if the temperature of the gas flow at a sensor 101, 102 is higher than the predefined temperature is to deactivate the corresponding sensor 101, 102, in particular to deactivate the heating element. The supply of current to the sensor is interrupted. As a result of the interruption of the gas flow in the line 110 and the deactivation of the at least one heating element, a propagation of a fire of the hydrocarbon gas can be prevented as effectively as possible.

Figure 2:
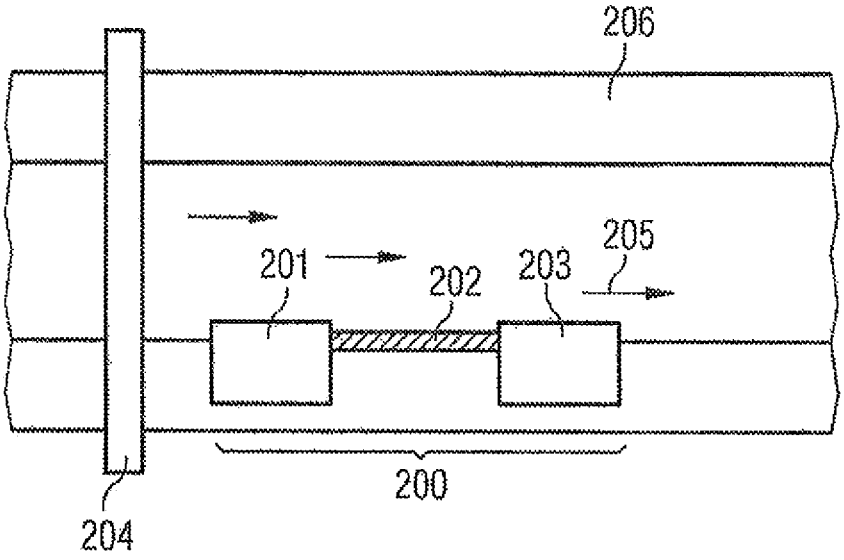
FIG. 2 is a schematic illustration of a sensor and a valve in a line.

FIG. 2 shows a sensor 200 and a valve 204 which are arranged in a line 206. A gas 205 is conducted in the line 206. The sensor 200 has a temperature sensor 201 and a further temperature sensor 203, which are arranged on, in each case, one side of a heating element 202. The sensor 200 is designed to measure the concentration of hydrocarbons in the gas 205. The valve 204 can close off the line 206 such that no gas passes through the valve. The sensor 200 can be coupled to a comparison device which is for example part of an engine controller of an internal combustion engine.

The sensor 200 is for example integrated on a silicon substrate and may comprise further elements, for example an evaluation circuit or an analog-digital converter. The gas 205 flowing past the sensor 200 is heated up to a defined extent by the heating element 202. The temperature sensor 201, which is arranged upstream of the heating element, measures the temperature of the gas flow before the gas flow is heated up; the further temperature sensor 203, which is arranged downstream of the heating element 202, measures the temperature of the heated-up gas. The heat capacity of the gas can be inferred from a difference between said temperatures. From this, the content of hydrocarbons in the gas 205 can be determined.

The comparison device 116 can compare the temperature of the temperature sensor 201 with a predefined temperature. The comparison device 116 can alternatively or additionally compare the temperature of the further temperature sensor 203 with a predefined temperature. The comparison device 116 can also compare the temperature difference between the two measured temperatures with a predefined temperature difference. The predefined temperature or the predefined temperature difference constitutes an upper limit of the temperature which occurs during intended operation of the sensor 200. If the temperature is higher than the predefined temperature, it can be concluded that there is a fire of the gas 205 in the line 206. If the temperature difference is greater than the predefined temperature difference, it can be concluded that there is a fire of the gas 205 in the line 206. If the comparison device detects a higher temperature than the predefined temperature or a greater temperature difference than the predefined temperature difference, said comparison device can regulate the valve 204 such that no additional gas can pass to the sensor 200. Furthermore, the supply of current to the sensor 200, in particular to the heating element 202, can be interrupted in order to eliminate a possible cause of fire. As a result of the deactivation or interruption of the supply of current to the sensor, a fire-causing malfunction, for example the formation of a spark, is suppressed, and the faulty sensor is thereby prevented from triggering a further fire.

Figure 3:
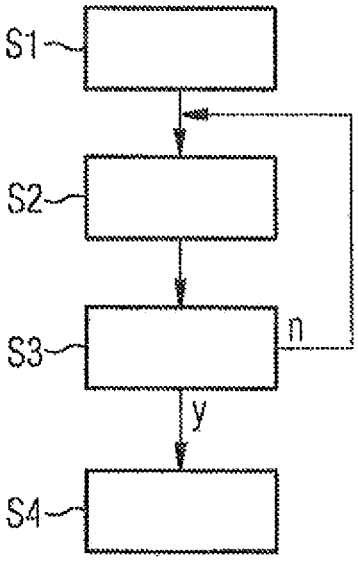
FIG. 3 is a flow diagram of a method.

Referring to FIG. 3, in a first step S1 of a method for operating an internal combustion engine, the start takes place, which may be close in terms of time to a start of the internal combustion engine.

In a second step S2, a temperature is determined at at least one sensor. The sensor is a sensor for measuring a hydrocarbon content of a gas flow in the internal combustion engine.

In a third step S3, the determined temperature is compared with a predefined temperature, and it is established whether the determined temperature is higher than the predefined temperature. If the determined temperature is not higher than the predefined temperature, the method continues with step S2. If the determined temperature is higher than the predefined temperature, then in step S4 the gas flow in the line is interrupted.

Furthermore, in step S4, a heating element of the sensor can be deactivated, and/or the supply of current to the heating element or to the sensor can be interrupted. The determination of the temperature at the at least one sensor in step S2 may take place by evaluating a signal of a temperature sensor. The temperature sensor is for example a semiconductor component which is integrated in the at least one sensor.

In a further exemplary embodiment of the method, in step S2 a first temperature is determined by a temperature sensor of the at least one sensor. A further temperature is determined by a further temperature sensor of the at least one sensor, and a temperature difference is determined between the temperature and the further temperature. In step S3, the temperature difference is compared with a predefined temperature difference and it is established whether the temperature difference is greater than the predefined temperature difference. If so, then in step S4, a valve is for example closed in order to interrupt a gas flow, and/or the sensor is deactivated. If the temperature difference is not greater than the predefined temperature difference, the method continues with step S2.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating an internal combustion engine comprising at least one sensor configured to measure a hydrocarbon content of a gas flow in a line, comprising:

determining a first temperature at a first temperature sensor of the at least one sensor;

determining a second temperature at a second temperature sensor of the at least one sensor;

determining a temperature difference between the first temperature and the second temperature; and interrupting the gas flow at the at least one sensor if the determined temperature difference is greater than a predefined temperature difference.

2. The method as claimed in claim 1, further comprising:

closing at least one valve arranged upstream of the at least one sensor in the line.

3. The method as claimed in claim 2, wherein the at least one sensor comprises at least one heating element configured to heat the gas flow, the method further comprising:

deactivating the at least one heating element.

4. An internal combustion engine system, comprising:

at least one sensor configured to measure a hydrocarbon content of a gas flow in a line;

at least one valve arranged upstream of the at least one sensor configured to interrupt the gas flow; and a comparison device that:

compares a first temperature determined at a first temperature sensor of the at least one sensor with a second temperature determined at a second temperature sensor of the at least one sensor;

determines a temperature difference between the first temperature and the second temperature; and regulates the valve to interrupt the gas flow through the line if the determined temperature difference is greater than a predefined temperature difference.

5. The internal combustion engine system as claimed in claim 4, wherein the at least one sensor further comprises:

at least one heating element configured to heat the gas flow.

6. The internal combustion engine as claimed in claim 4, wherein the comparison device is part of an engine controller.

* * * * *